United States Patent [19]

McConnell

[11] Patent Number: 4,929,003

[45] Date of Patent: May 29, 1990

[54] MOTORIZED LOCKING MECHANISM FOR A DOOR

[75] Inventor: Lloyd T. McConnell, Duncanville, Tex.

[73] Assignee: Adtec Incorporated, San Antonio, Tex.

[21] Appl. No.: 255,017

[22] Filed: Oct. 7, 1988

[51] Int. Cl.[5] ..... E05C 3/06

[52] U.S. Cl. ..... 292/144; 292/150; 292/170

[58] Field of Search ..... 292/144, 170, 150, 37, 292/41, 140, 159, 169 R, 174

[56] References Cited

U.S. PATENT DOCUMENTS

| | | | |
|---|---|---|---|
| Re. 27,013 | 12/1970 | Hedin et al. | 70/277 |
| 2,219,132 | 10/1940 | Hohmann et al. | 292/45 |
| 2,517,378 | 8/1950 | Aspenwall et al. | 292/170 |
| 3,455,127 | 7/1969 | Simon | 70/277 |
| 3,599,454 | 8/1971 | Hill et al. | 70/265 |
| 3,640,560 | 2/1972 | Zawadzki et al. | 292/341.16 |
| 3,854,310 | 12/1974 | Paull et al. | 70/280 |
| 3,893,723 | 7/1975 | Boule | 292/170 X |
| 3,901,542 | 8/1975 | Salzman et al. | 292/144 |
| 4,211,443 | 7/1980 | Butts et al. | 292/341.16 |
| 4,232,353 | 11/1980 | Mosciatti et al. | 361/172 |
| 4,390,758 | 6/1983 | Hendrickson | 200/43 |
| 4,509,347 | 4/1985 | Young | 70/129 |
| 4,563,886 | 1/1986 | Kletzmaier et al. | 70/118 |
| 4,568,998 | 2/1986 | Kristy | 361/172 |
| 4,593,543 | 6/1986 | Stefanek | 70/134 |
| 4,616,491 | 10/1986 | Genest | 70/276 |
| 4,633,687 | 1/1987 | Fane | 70/276 |
| 4,672,826 | 6/1987 | Mombelli | 70/278 |
| 4,703,637 | 11/1987 | Diemert | 70/277 |
| 4,744,021 | 5/1988 | Kristy | 364/141 |

*Primary Examiner*—Richard E. Moore

*Attorney, Agent, or Firm*—Nydegger & Harshman

[57] ABSTRACT

A motorized door locking mechanism comprises a base on which a bolt and a latch are reciprocally mounted. A cam plate is slideably mounted on the base for movement between first, second and third positions and is operatively connected with the bolt and latch to control the position and movement of the bolt in response to positioning of the latch and cam plate. In its first position, the cam plate holds the bolt in a forward or locked position. In its second position, the cam plate is held by the latch for as long as the door is closed while the cam plate itself holds the bolt in a retracted or unlocked position. When the unlocked door is opened, the latch releases to allow movement of the cam plate into its third position. The bolt can then move between its forward and retracted positions as long as the door remains open. Subsequent closing of the door again moves the latch and returns the cam plate to the first position for locking the bolt. A motor operatively connected to the cam plate moves the cam plate from the first to the second position. Subsequently, depending on door position and the consequent position of the latch, the cam plate is successively urged from the second position and into its third and first positions.

20 Claims, 6 Drawing Sheets

MOTORIZED LOCKING MECHANISM FOR A DOOR

FIELD OF THE INVENTION

This invention relates generally to motorized door locking mechanisms. More particularly, this invention relates to the camming mechanism for a mechanized power lock which drives a bolt between locked and unlocked positions and rigidly holds the bolt when it is in the locked position The present invention is particularly, but not exclusively, useful for locking prison security doors.

BACKGROUND OF THE INVENTION

Many versions of motorized or electrically operated door locking assemblies have been proposed. Typically, automated mechanisms are solenoid operated and, thus, are not easily activated when strong resistive forces are applied to the mechanism. This problem can obviously be very detrimental if the locking mechanism is to be used in a prison or a correctional facility where it is not inconceivable that inmates may attempt to compromise the locking mechanism.

On the other hand, locking mechanisms which are sturdy enough to be used in a prison environment are generally fairly complicated in their structure. Unfortunately, their complexity can require additional force requirements for effective operation of the system which necessitate larger power packs and make the whole mechanism more bulky. Some examples of presently available locking mechanisms include the "Electric Strike" as disclosed and claimed in U.S. Pat. No. 4,211,443 to Butts et al., the "Security Lock" as disclosed and claimed in U.S. Pat. No. 4,593,543 to Stefanek, and the "Electric Latch Strike" as disclosed and claimed in U.S. Pat. No. 3,640,560 to Zawardski et al.

With these and other devices in mind, the present invention recognizes there is a need for a motorized locking mechanism which is exceedingly strong yet uncomplicated in structure and simple to operate. More specifically, the present invention recognizes that an effective locking mechanism need incorporate only a few moving parts and can be configured for easy mounting in a doorjamb.

In light of the above, an object of the present invention is to provide a door locking mechanism which is sufficiently strong for effective use in a prison or correctional facility. Another object of the present invention is to provide a door locking mechanism which has only a few operating moveable parts. Still another object of the present invention is to provide a door locking mechanism which is able to operate against relatively strong resistive forces. Yet another object of the present invention is to provide a door locking mechanism which is cost effective and relatively easy to manufacture.

SUMMARY OF THE INVENTION

A preferred embodiment of the novel door locking mechanism of the present invention comprises a base plate on which a bolt and a latch are slideably mounted for independent reciprocal movement between respective forward and retracted positions. Means are provided to urge both the latch and the bolt toward their forward positions.

A cam plate is slideably mounted on the base plate for cyclic movement between a first, a second and a third position. A spring, or some other elastic means, is provided to continuously urge the cam plate toward and into the first position and other means, such as a motor, is used to selectively move the cam plate from the first to the second position to begin the cycle. The cam plate is formed with a cam hole and a cam recess which are respectively engaged with the bolt and the latch to operatively position the bolt. Additionally, the cam plate is formed with an abutment which engages with the bolt to hold it in its forward or locked position when the cam plate is in its first position. Further, the latch and the cam recess cooperate with each other to position the cam plate in its second and third positions for controlling movement of the bolt in its cooperation with the cam hole.

The operation of the door locking mechanism of the present invention is best understood by sequentially considering the cooperation of the latch and the bolt in their relationship to the positions of the cam plate. In the cam plate's first position, the door is intended to be closed with the latch forced into its retracted position. Additionally, the bolt is urged forward into its locked position and the abutment on the cam plate engages the bolt to hold it in this locked position. Movement of the cam plate from the first position to the second position can be accomplished by either manual or motorized activation. In either case, this cam plate movement disengages the abutment from the bolt and causes the bolt to be withdrawn into its retracted position. Simultaneously, this movement aligns a spring loaded pin on the latch with a groove in the cam recess to allow insertion of the pin into the groove. This interaction between pin and groove holds the cam plate in the second position for as long as the door remains closed.

Movement of the cam plate into its third position is accomplished by opening the door. This allows the latch and its spring loaded pin to slide forward and out of the groove. Thus, with the latch no longer holding the cam plate in its second position, the cam plate is urged toward its first position. During this movement, however, the spring-loaded pin on the latch abuts against a beveled surface in the cam recess which stops further movement of the cam plate toward its first position. Instead, the cam plate is held in its third position which is intermediate the first and second position. Importantly, when the cam plate is in its third position, the bolt clears the abutment on the cam plate and is allowed to reciprocally move between its forward or locked position and its retracted or unlocked position. This permits the door to be closed.

When the door is closed, the latch is forced into its retracted position and the spring-loaded pin is consequently moved off of the beveled surface. With the latch so positioned, the bolt is urged into its forward position to free the cam plate for a return to its first position. Simultaneously, the abutment engages against the bolt to hold the bolt in its locked position. From here the cycle is repeatable.

As contemplated by the present invention, the locking mechanism itself is mounted in the doorjamb and the striker plate with its locking recess, which is aligned for engagement with the bolt, is mounted on the door. Thus, with the door closed, the strike plate urges the latch into its retracted position and the locking mechanism can be configured with the cam plate in either the first position wherein the bolt is inserted and locked in the locking recess of the striker plate or in the second position wherein the bolt is retracted to permit opening the door. Once the door is opened, the striker plate no longer urges the latch into its retracted position and, instead, the latch is urged into its forward position to move the cam plate into its third position. It is to be understood, however, that the door locking mechanism of the present invention could be just as easily mounted in the door itself. Its operation would be essentially the same.

In an alternate embodiment of the present invention, the groove in the cam recess is eliminated. The elimination of this groove allows relocking of the door, i.e. a return of the bolt to the locked position, while the door remains closed. Specifically, in the alternate embodiment, there is no engaging structure with which the spring loaded pin on the latch can cooperate to hold the cam plate in the second position.

The novel features of this invention, as well as the invention itself, both as to its structure and its operation, will be best understood from the accompanying drawings, taken in conjunction with the accompanying description, in which similar reference characters refer to similar parts, and in which:

DESCRIPTION OF THE PREFERRED EMBODIMENT

Figure 1:
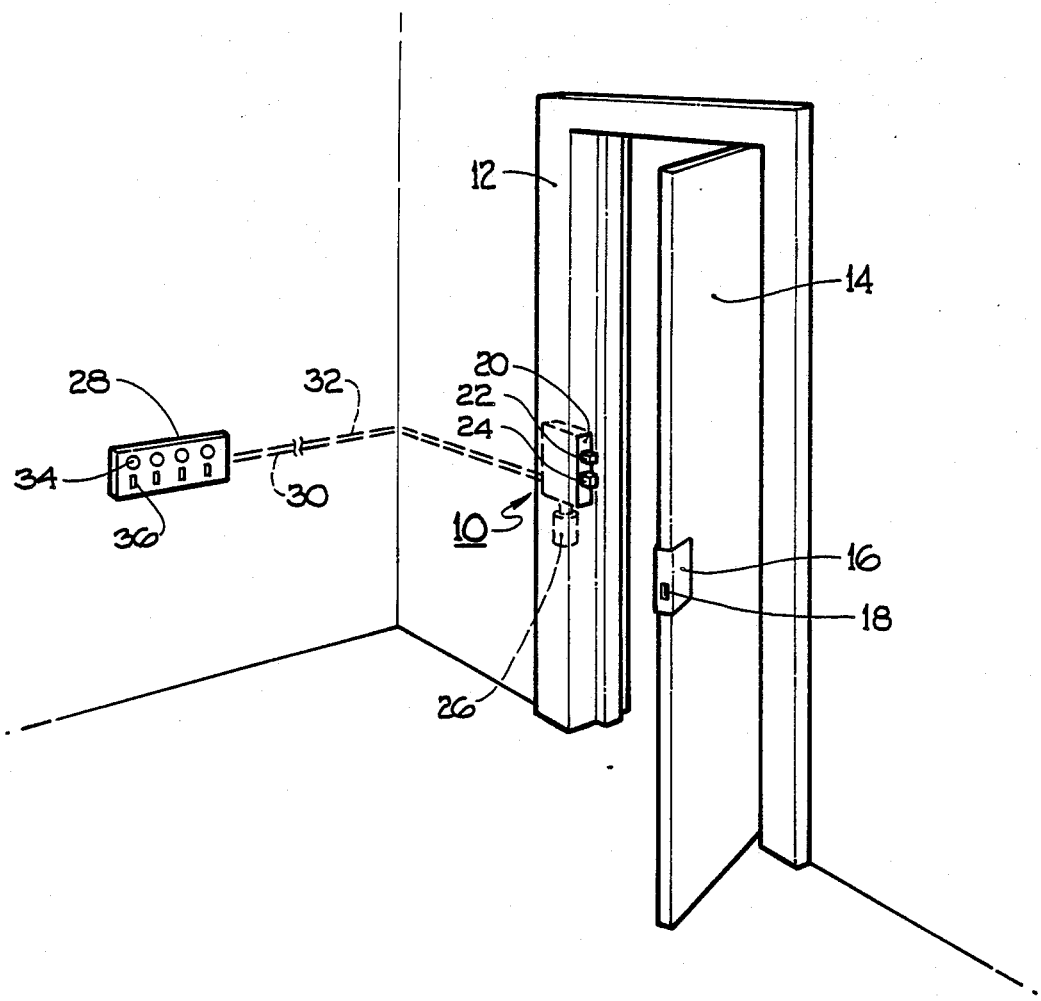
FIG. 1 is a perspective view of an open door and a perspective view, partially in phantom, of the present invention mounted in the doorjamb.

Referring initially to FIG. 1, the door locking mechanism of the present invention is shown in its operative environment and generally designated 10. As shown, door locking mechanism 10 is mounted in the doorjamb 12 for operative engagement with door 14 when the door 14 is closed. A striker plate 16 having a recess 18 is mounted on door 14 and is aligned or positioned for operative engagement with door locking mechanism 10 when door 14 is closed.

The door locking mechanism 10 includes a base plate 20 on which are reciprocally mounted a latch 22 and a bolt 24. Through a cooperation of structure to be subsequently discussed in greater detail, a motor 26 is provided for operating mechanism 10 in a manner which engages bolt 24 with recess 18 to lock door 14 in a closed position with respect to doorjamb 12. As contemplated by the present invention, door locking mechanism 10 is dimensioned to properly fit within a relatively narrow doorjamb 12. For example, typical dimensions for mechanism 10 are approximately 10.5 inches in height and 1.5 inches in width with a depth of approximately 0.85 inches. While these dimensions are not intended to be limiting they do provide an indication of an operable size for the locking mechanism 10.

FIG. 1 also shows that a remote door activator 28 can be provided which is electronically connected with locking mechanism 10 by transmission lines 30 and 32. More specifically, an indicator 34 on door activator 28 is connected with door locking mechanism 10 by way of transmission line 32 for the purpose of providing information on the locked or unlocked condition of door locking mechanism 10. Activator buttons 36 are also provided on door activator 28 for the purpose of providing electronic and, therefore, remote activation of motor 26 for unlocking the door locking mechanism 10. It will be appreciated that manual means (not shown) may also be provided for door locking mechanism 10 which will allow a locking and unlocking operation of mechanism 10 without requiring activation of a button 36.

Figure 2:
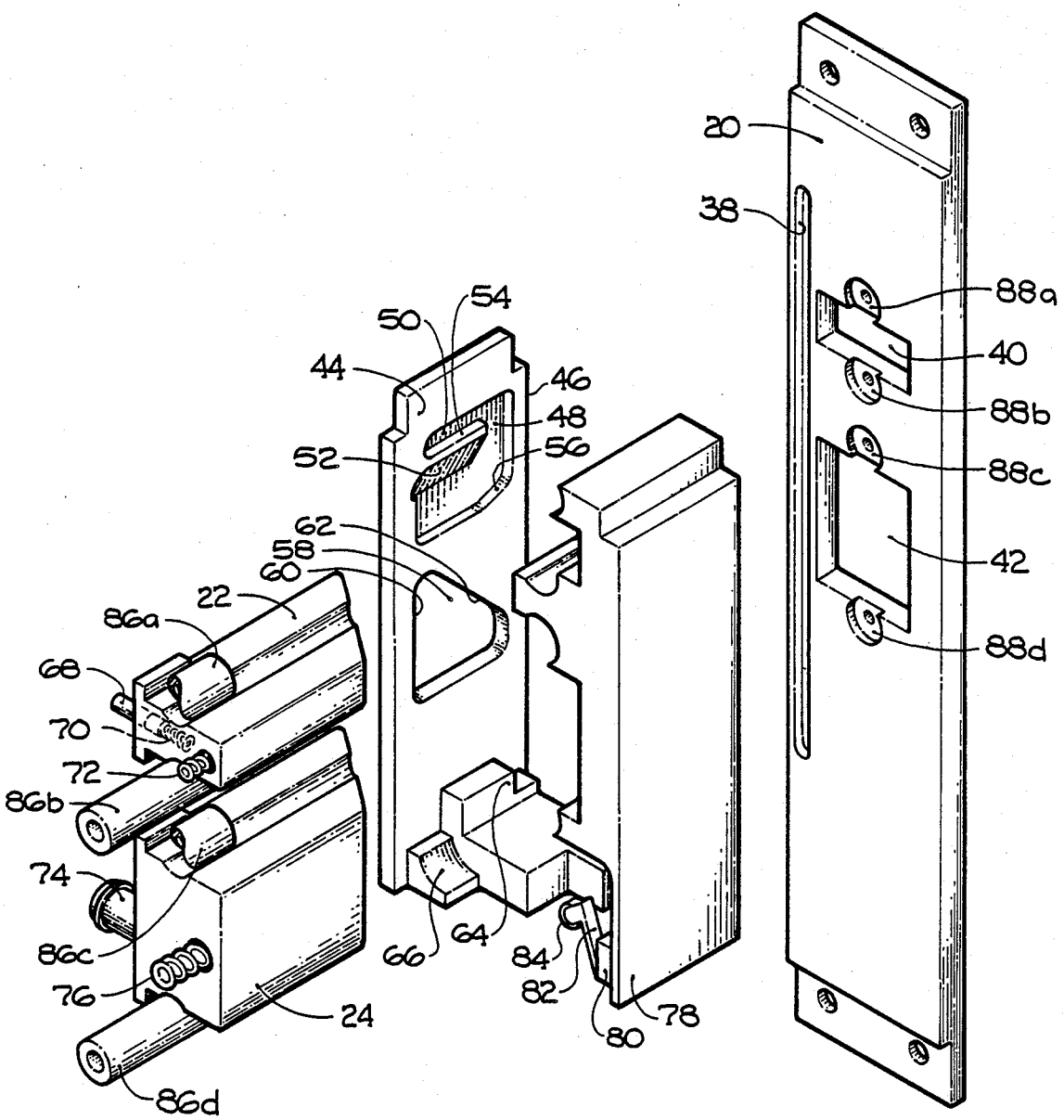
FIG. 2 is an exploded isometric view of the door locking mechanism of the present invention.

FIG. 2 shows that base plate 20 is a substantially rectangular elongated flat plate which is formed with a slide groove 38 that is located near and substantially parallel to an edge of base plate 20. Further, FIG. 2 shows that base plate 20 is formed with a latch hole 40 and a bolt hole 42.

A cam plate 44 is provided which has a guide edge 46 which is dimensioned to be slidingly received in slide groove 38 of base plate 20. Specifically, cam plate 44 is slidingly mounted substantially perpendicular to base plate 20 for movement in a direction that parallels the longitudinal axis of base plate 20. As shown, cam plate 44 is formed with a cam recess 48 which creates a configured indentation in the surface of cam plate 44. More specifically, cam recess 48 is configured with a groove 50 which is established by a ramp 52 that extends into cam recess 48 in a direction substantially perpendicular to the orientation of guide edge 46. Also, ramp 52 defines a lip 54 which will cooperate with other structure to be subsequently discussed. Cam recess 48 further defines a bevel surface 56 which, like lip 54, will cooperate with other structure to be subsequently discussed.

Cam plate 44, in addition to being formed with cam recess 48, is also formed with a cam hole 58 which extends through cam plate 44 and is defined by an edge 60. As shown in FIG. 2, a portion of this edge 60 establishes an incline surface 62. Cam plate 44 is further characterized by an abutment 64 which is attached to the cam plate 44 in any manner well known in the pertinent art, such as by bolting or cementing. A tripper 66 is also mounted on cam plate 44 substantially as shown for a purpose to be subsequently disclosed. Latch 22 comprises a keeper pin 68 which is urged by spring 70 into cam recess 48 of cam plate 44 when mechanism 10 is assembled. Another spring 72 is mounted on latch 22 substantially as shown to urge latch 22 forward in a direction which will extend latch 22 through latch hole 40.

Still referring to FIG. 2, it will be seen that bolt 24 is formed with a bolt pin 74 that is adapted to be received in cam hole 58 of cam plate 44. Specifically, it is intended that bolt pin 74 be guided in its interaction with edge 60 of cam hole 58 for operative movement of the bolt 24 relative to mechanism 10. A spring 76 is provided which urges bolt 24 in a direction which would cause bolt 24 to extend through bolt hole 42. A housing 78 is provided which can be attached to base plate 20 in any manner well known in the pertinent art, such as by bolting or welding, or through cooperative interaction with other structure. As shown, a microswitch 80 is mounted on housing 78 and has an arm 82 and a cooperative roller 84 extending therefrom for operative interaction with tripper 66. As will be subsequently appreciated, when bolt 24 is locked, tripper 66 will engage with roller 84 of arm 88 to engage microswitch 80. When microswitch 80 is engaged, a signal is sent via line 32 to an indicator 34 to show that mechanism 10 is locked. FIG. 2 also shows a series of guide rods 86*a*, 86*b*, 86*c* and 86*d* which are respectively held in rod seats 88*a*, 88*b*, 88*c* and 88*d* for the purpose of guiding latch 22 and bolt 24 in their operative reciprocal movement relative to mechanism 10.

It can be appreciated with reference to FIG. 2 that, when housing 78 is positioned and mounted on base plate 20 and when cam plate 44 is slideably engaged with slide groove 38 of base plate 20, a structure is provided within which the latch 22 and bolt 24 can be reciprocally mounted on base plate 20. Specifically, guide rods 86*a*, 86*b*, 86*c* and 86*d* are held in respective rod seats 88*a*, 88*b*, 88*c* and 88*d* in any manner well known in the art and, as shown, latch 24 is positioned between these guide rods 86*a* and 86*b* for reciprocal movement relative to base plate 20. This also positions keeper pin 68 within cam recess 48. Likewise, guide rods 86*c* and 86*d* restrain bolt 24 on mechanism 10 in a position for reciprocal movement with respect to base plate 20 which allows bolt 24 to pass through bolt hole 42. Further, mounting of bolt 24 in the manner as described causes bolt pin 74 to be inserted into cam hole 58 where it is urged against edge 60 for moving bolt 24 in response to prescribed cyclical movements of cam plate 44. Though not shown, it can be appreciated that another plate is engageable with rods 86*a*, 86*b*, 86*c* and 86*d* opposite from the base plate 20. This other plate will provide a base against which springs 72 and 76 can be seated and can provide additional stability for sliding cam plate 44.

Figure 3A:
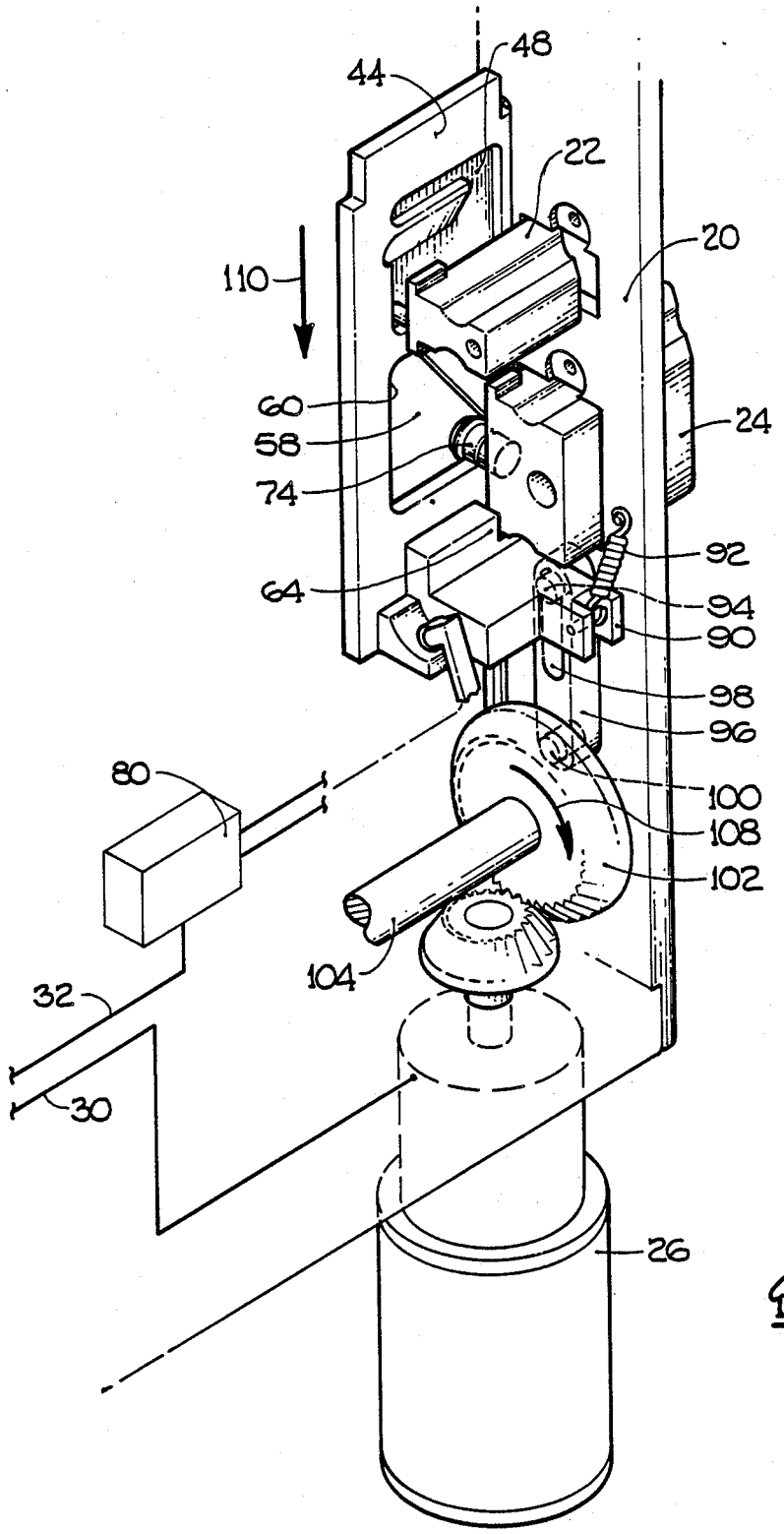
FIG. 3A is an isometric view of the door locking mechanism of the present invention in a bolt locked configuration.

FIG. 3A shows that cam plate 44 is formed with an extension 90 which is connected to base plate 20 by a spring 92. Fixedly attached to the extension 90 of cam plate 44 is a pin 94 which is operatively connected to a drive link 96. Specifically, drive link 96 is formed with a slot 98 which receives the pin 94 therein. A pin connector 100 which is fixedly mounted on a circular drive gear 102 is also operatively connected with drive link 96 while the drive gear 102 is itself mounted for rotation on mechanism 10 by a support shaft 104. Although the actual connection of support shaft 104 with the mechanism 10 is not shown, it is to be understood that shaft 104 is rotatably mounted on other structure of mechanism 10. Further, FIG. 3A shows that drive gear 102 is meshingly engaged with a bevel gear 106.

Figure 3B:
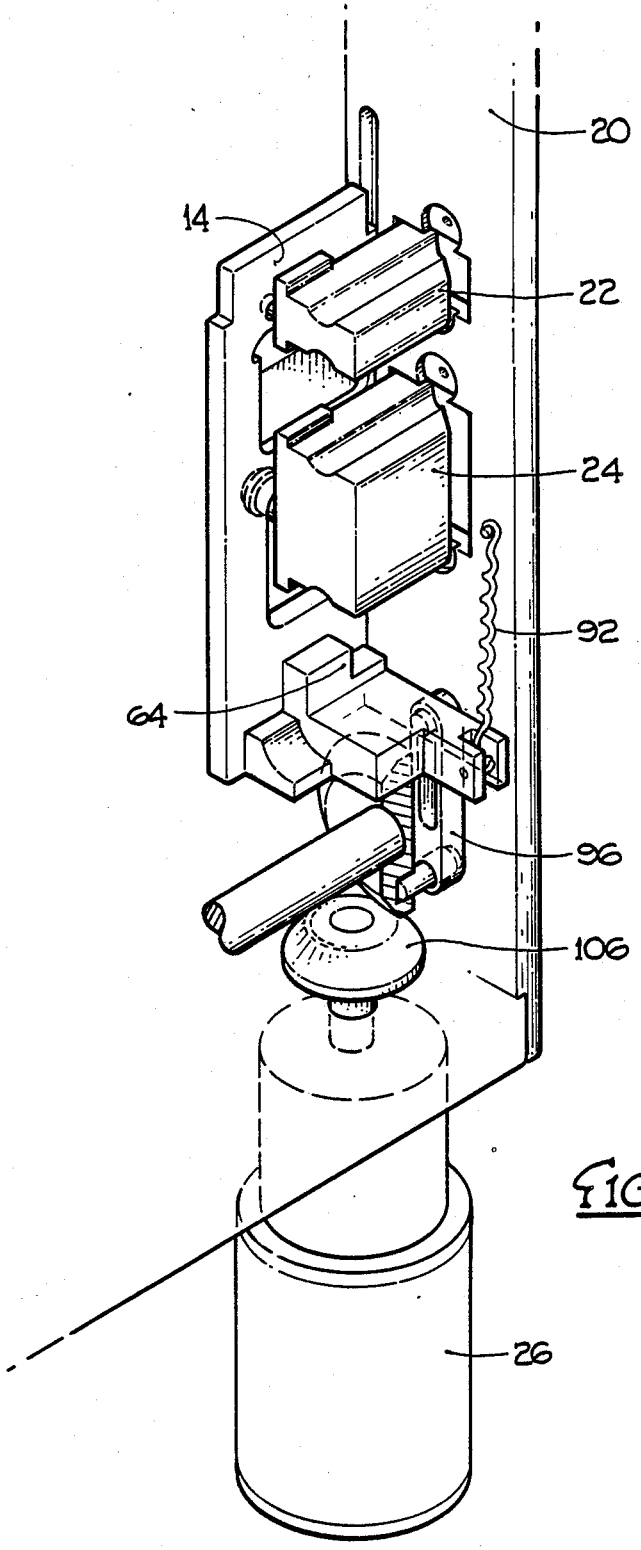
FIG. 3B is an isometric view of the door locking mechanism of the present invention in an unlocked position while the door is closed.

With the above-disclosed interconnection of structure, it will be appreciated by the skilled artisan that actuation of an activator button 36 will send a signal via transmission line 30 to start motor 26. Motor 26 then rotates bevel gear 106 in a direction which causes drive gear 102 to rotate in the direction indicated by arrow 108. This rotation of drive gear 102 causes a corresponding movement of pin connector 100 which pulls on drive link 96 to cause a consequent movement of pin 94 and connected cam plate 44 in the direction of arrow 110. In accordance with the above, it is to be appreciated that a half rotation of drive gear 102 will cause movement of cam plate 44 from a position substantially as shown in FIG. 3A to a position as substantially shown in FIG. 3B. This will cause cam plate 44 to interact with latch 22 and bolt 24 in a manner which withdraws bolt 24 from its locked position shown in FIG. 3A to its retracted position shown in FIG. 3B.

OPERATION

Figure 4:
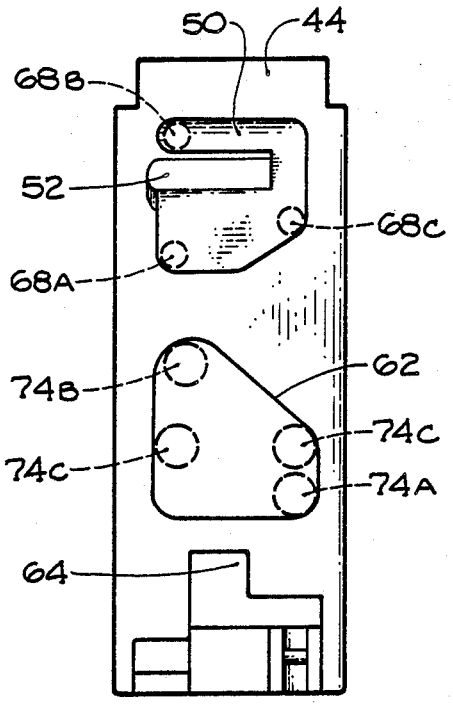
FIG. 4 is an elevational view of the cam plate of the present invention.
Figure 6:
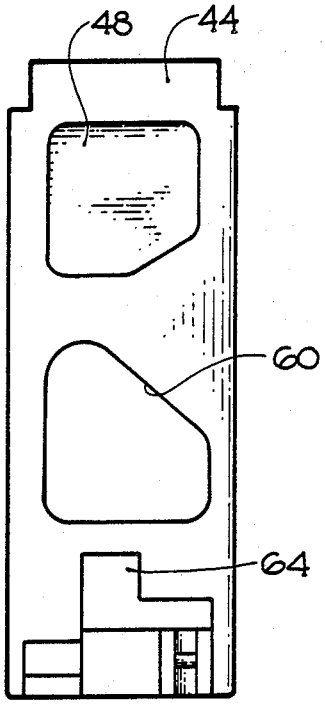
FIG. 6 is an elevational view of an alternate embodiment of the cam plate of the present invention.
Figures 5A, 5B, 5C:
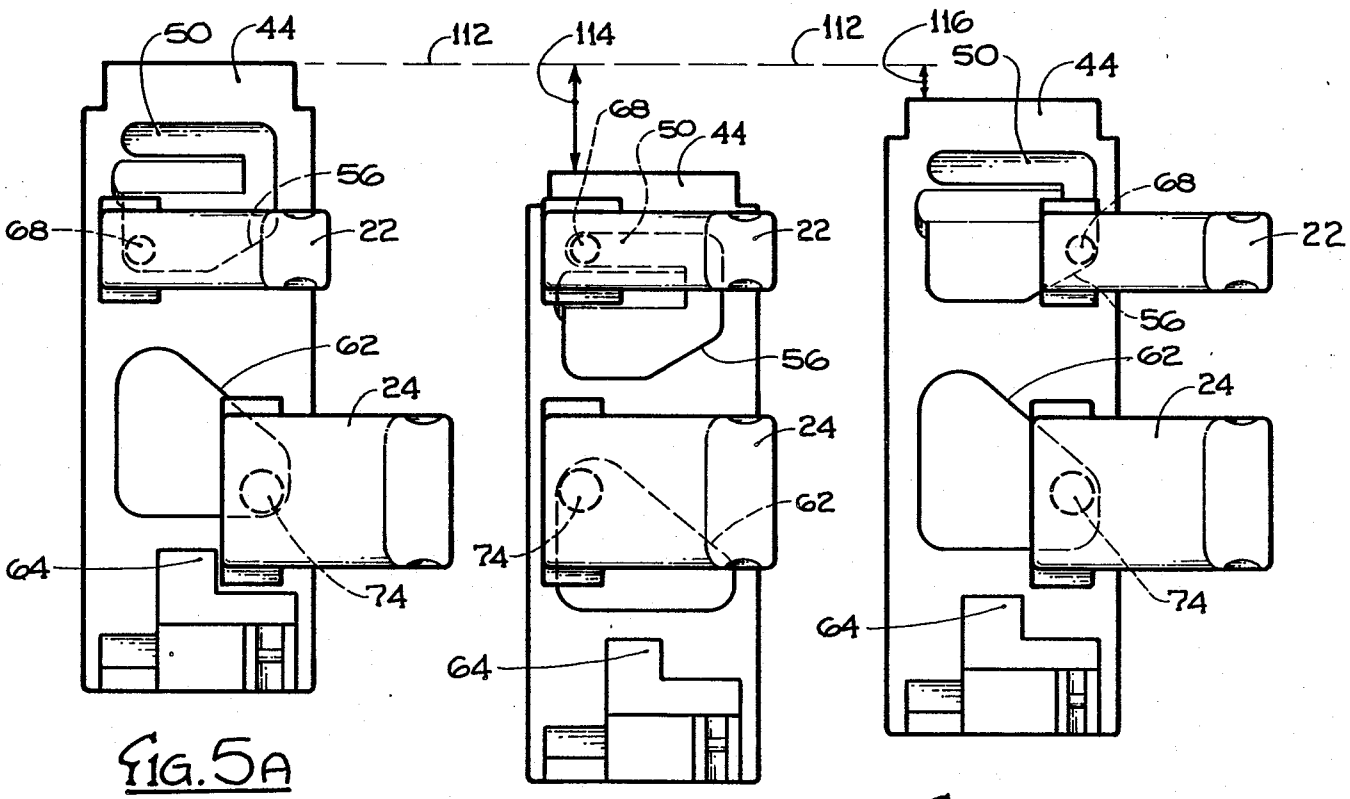
FIG. 5A, 5B and 5C are elevational views of the cam plate, latch and bolt of the door locking mechanism in configurations respectively corresponding to a bolt locked position, a bolt unlocked position, and a free-to-reciprocate position.

The operation of door locking mechanism 10 will be best understood after some specific corresponding cross-references between figures are established. To begin with, the configuration of structural elements shown for mechanism 10 in FIG. 3A corresponds to the configuration of cam plate 44, latch 22 and bolt 24 as shown in FIG. 5A. Similarly, the cooperation of elements shown for mechanism 10 in FIG. 3B corresponds to the configuration of cam plate 44, latch 22 and bolt 24 as shown in FIG. 5B. Thus, FIG. 3A corresponds to FIG. 5A and FIG. 3B corresponds to FIG. 5B. For additional cross-referencing, the various operative relative positions of keeper pin 68 and bolt pin 74, as shown in FIG. 4 and indicated by the respective characters 68A, 68B and 68C and 74A, 74B and 74C, respectively correspond to the positions of these structures as shown in FIGS. 5A, 5B and 5C. Specifically, in FIG. 4 the location for keeper pin 68A and bolt pin 74A correspond to the respective positions of these parts shown in FIG. 5A. Likewise, keeper pin 68B and bolt pin 74B correspond to their respective positions in FIG. 5B while keeper pin 68C and bolt pin 74C correspond to the positions shown for these structures in FIG. 5C. As perhaps best seen in FIG. 4, the relative positions of keeper pin 68 and bolt pin 74 in cam recess 48 and cam hole 58 of cam plate 44 determine the operation of bolt 24.

It is first to be understood that the datum line 112 in FIGS. 5A, 5B and 5C is established for purposes of showing the relative position of cam plate 44. More specifically, with cam plate 44 touching datum line 112 cam plate 44 is considered to be in its first position. This is as shown in FIG. 5A. When cam plate 44 is displaced from datum line 112 through the displacement 114, cam plate 44 is considered to be in its second position This second position is shown in FIG. 5B. Similarly, when cam plate 44 is displaced from datum line 112 through the displacement 116, cam plate 44 is in its third position. This is as shown in FIG. 5C. Irrespective of the position of cam plate 44, it will be seen in cross-referencing FIGS. 5A, 5B and 5C that both latch 22 and bolt 24 only reciprocate. In other words, latch 22 and bolt 24 are confined in mechanism 10 for only linear movement.

The actual operation of door locking mechanism 10 is perhaps best understood by initially considering bolt 24 in its forward or locked position. This configuration is shown in both FIG. 3A and FIG. 5A. More specifically, referring to FIG. 5A, it will be noticed that when bolt 24 is in its forward or locked position, the abutment 64 engages against bolt 24 in a manner substantially as shown to lock and fixedly hold bolt 24 in the forward position. This, of course, allows insertion of the bolt 24 into recess 18 of striker plate 16 for the purpose of holding door 14 in a closed relationship with respect to doorjamb 12. With bolt 24 in its locked position, latch 22 is simultaneously urged by the striker plate 16 into its retracted position. In this case, the position of keeper pin 68 will be as shown in FIG. 5A. A cross-reference to FIG. 4 will show that keeper pin 68A is in its retracted position and bolt pin 74A is in its forward or locked position when door 14 is closed onto doorjamb 12.

Manipulation of an activator button 36 on door activator 28 causes an electrical signal to be transmitted to motor 26 which energizes motor 26 for consequent rotation of bevel gear 106 and drive gear 102. Specifically, a one-half rotation of drive gear 108 causes a movement of drive link 96 that pulls cam plate 44 from its first position as shown in FIG. 5A to its second position as shown in FIG. 5B. During the movement of cam plate 44 from its first position to its second position, bolt pin 74 is caused to engage against incline surface 62. This engagement overrides the effect of spring 76 and moves bolt 24 from its forward or locked position shown in FIG. 5A into its retracted or unlocked position shown in FIG. 5B. This corresponds to movement as shown in FIG. 4 of bolt pin 74A to the position for bolt pin 74B. While bolt 24 is being moved into its retracted position as a consequence of the movement of cam plate 44 from its first position to its second position, latch 22 which was already in a retracted position is caused to move with respect to cam recess 48 to align the latch 22 with groove 50. Specifically, as cam plate 44 is moved from its first position to its second position, keeper pin 68 is caused to move along cam recess 48, and then ride up ramp 52 and over lip 54 into the position where spring 70 urges keeper pin 68 into the groove 50. Recall that the door 14 has remained closed relative to doorjamb 12 during the movement of cam plate 44 from its first to its second position. Accordingly, latch 22 has remained in its retracted position. It will be appreciated that as long as door 14 is closed, latch 22 will be held in its retracted position by the action of striker plate 16. Accordingly, keeper pin 68 will be confined to groove 50. This establishes the configuration as shown in FIG. 5B in which bolt 24 is held in its unlocked or retracted position.

As door 14 is opened, the latch 22 is allowed to move into its forward position under the influence and action of spring 72. This movement of keeper pin 68 along groove 50 allows keeper pin 68 to eventually escape from groove 50 when latch 22 moves into its full forward position. It happens that, throughout the movements being described, the action of spring 92 urges cam plate 44 toward its first position, i.e. its position as shown in FIG. 5A. Thus, as latch 22 moves into its forward position where keeper pin 68 will no longer confine cam plate 44 to its third position, cam plate 44 is moved under the influence of spring 92 toward its first position. During this movement, however, keeper pin 68 comes into contact with bevel surface 56 to prevent further movement of cam plate 44 toward its first position. The result is that cam plate 44 is held in its third position as shown in FIG. 5C.

While cam plate 44 is in its third position, latch 22 is still urged by spring 72 into its forward position in a manner which causes keeper pin 68 to interact with bevel surface 56 for holding cam plate 44 in this position. During the movement of cam plate 44 from its second position as shown in FIG. 5B to its third position as shown in FIG. 5C, bolt pin 74 has been allowed to ride along incline surface 62 into its forward position as shown in FIG. 5C. Importantly, while cam plate 44 is being held by the action of keeper pin 68 against bevel surface 56, bolt 24 is held away from an interactive position with abutment 64. Consequently, while door 14 remains opened, bolt 24 is able to reciprocate between its forward position as shown in FIG. 5C and a retracted position. This retracted position is indicated in cross-reference to FIG. 4 as the location for bolt pin 74C'. This then will allow bolt 24 to be reciprocated in a manner which permits closing door 14 onto doorjamb 12. It is to be understood that as door 14 is closed onto doorjamb 12, the action of striker plate 16 against latch 22 causes latch 22 to be moved from its forward position shown in FIG. 5C to its retracted position shown in FIG. 5A. This movement also causes keeper pin 68 to move off of bevel surface 56 and, consequently, allow the action of spring 92 to continue urging cam plate 44 into its first position shown in FIG. 5A. Having gone through this cycle, it will be appreciated that door locking mechanism 10 has been returned to a configuration as substantially shown in FIG. 5A and that the mechanism 10 is effectively returned to a configuration in which door 14 is locked in a closed relationship with respect to doorjamb 12.

The above-described cycle of configurations can be accomplished repetitively as desired by the operator. While the operation thus far disclosed has focused on a motorized operation for the door locking mechanism 10, it is to be understood that cam plate 44 could be moved from the first position into the second position by the manual action of a key (not shown). This is possible because, while cam plate 44 is in its first position, pin 94 is free to move along slot 98 of drive link 96.

In an alternate embodiment of the present invention, groove 50 is eliminated from the cam recess 48 of cam plate 44. Without the action of groove 50 confining latch 22, cam plate 44 can be moved from the first position shown in FIG. 5A to its second position as shown in FIG. 5B and back without passing through the third position. This, of course, allows mechanism 10 to be operated in a manner which locks and unlocks door 14 without the necessity of door 14 ever having been opened.

While the particular door locking mechanism as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as defined in the appended claims.

I claim:

1. A mechanism for locking a door in a closed relationship with a doorjamb which comprises:

a base plate;

a bolt slideably mounted on said base plate for movement with respect thereto between a locked position wherein said bolt holds the door and doorjamb in the closed relationship and an unlocked position;

a cam plate operatively engaged with said bolt and slideably mounted on said base plate for movement on said base between a first position wherein said cam plate holds said bolt in said locked position, a second position wherein said cam plate holds said bolt in said unlocked position and a third position wherein said cam plate allows said bolt to move between said locked position and said unlocked position;

means for moving said cam plate;

a latch operatively engaged with said cam plate and slideably mounted on said base plate for movement with respect thereto between a forward position and a retracted position; and means for urging said latch toward said forward position to hold said cam plate in said third position while the door is open.

2. A mechanism for locking a door in a closed relationship with doorjamb as recited in claim 1 wherein said cam plate is formed with a groove and said mechanism further comprises a spring loaded keeper pin mounted on said latch to urge against said cam plate and hold said cam plate in said unlocked position when said keeper pin is urged into said groove.

3. A mechanism for locking a door in a closed relationship with a doorjamb as recited in claim 2 wherein said means for moving said cam plate comprises:

means connecting said base plate to said cam plate to urge said cam plate toward said first position; and means to counteract said connecting means and selectively pull said cam plate into said second position.

4. A mechanism for locking a door in a closed relationship with a doorjamb as recited in claim 3 wherein said cam plate is formed with a hole defining an edge and said mechanism further comprises:

means for urging said bolt toward said locked position; and a pin fixed to said bolt and insertable into said hole with said pin urged against said edge for responsive movement of said bolt according to the position of said cam plate.

5. A mechanism for locking a door in a closed relationship with a doorjamb as recited in claim 4 wherein said bolt is mounted on said base plate for reciprocal movement in a direction substantially perpendicular to said base plate.

6. A mechanism for locking a door in a closed relationship with a doorjamb as recited in claim 5 wherein said latch is mounted for reciprocal movement on said base plate in a direction substantially perpendicular to said base plate.

7. A mechanism for locking a door in a closed relationship with a doorjamb as recited in claim 6 wherein movement of said latch into said forward position or into said retracted position is responsive respectively to a door open condition and a door closed condition.

8. A mechanism for locking a door in a closed relationship with a doorjamb as recited in claim 3 wherein said means for connecting said base plate to said cam plate is a spring.

9. A mechanism for locking a door in a closed relationship with a doorjamb as recited in claim 8 wherein said means to counteract said connecting means is a motor operatively engaged with said cam plate.

10. A mechanism for locking a door in a closed relationship with a doorjamb as recited in claim 1 wherein said mechanism further comprises an abutment mounted on said cam plate and engageable with said bolt for urging against said bolt to hold said bolt in said first position.

11. A door locking mechanism which comprises:

a base plate;

a cam plate slideably mounted on said base plate for movement between a first position, a second position and a third position a bolt operatively connected to said cam plate to be held thereby in either a locked position or an unlocked position, or allowed to move between said locked and unlocked positions in response to the respective positioning of said cam plate in said first, second or third position;

a latch operatively engaged with said cam plate and slideably mounted on said base plate for movement with respect thereto between a forward position and a retracted position; and means for urging said latch toward said forward position to hold said cam plate in said third position while the door is open.

12. A mechanism for locking a door in a closed relationship with a doorjamb as recited in claim 11 wherein said cam plate is formed with a groove and said mechanism further comprises a spring loaded keeper pin mounted on said latch to urge against said cam plate and hold said cam plate in said unlocked position when said keeper pin is urged into said groove.

13. A mechanism for locking a door in a closed relationship with a doorjamb as recited in claim 12 wherein said means for moving said cam plate comprises:

means connecting said base plate to said cam plate to urge said cam plate toward said first position; and means to counteract said connecting means and selectively pull said cam plate into said second position.

14. A mechanism for locking a door in a closed relationship with a doorjamb as recited in claim 13 wherein said cam plate is formed with a hole defining an edge and said mechanism further comprises:

means for urging said bolt toward said locked position; and a pin fixed to said bolt and insertable into said hole with said pin urged against said edge for responsive movement of said bolt according to the position of said cam plate.

15. An apparatus for controlling the reciprocal movement of a door bolt between a locked position wherein the bolt holds a door and a doorjamb in a closed relationship and an unlocked position wherein said door can be opened relative to said doorjamb which comprises:

a base for reciprocally holding said bolt thereon;

a cam plate slideably mounted on said base plate for movement between a first position wherein said bolt is held in said locked position, a second position wherein said bolt is held in said unlocked position, and a third position wherein said bolt is reciprocally moveable between said locked and said unlocked positions;

a latch slideably mounted on said base plate and operatively engageable with said cam plate while being urged into a retracted position by said door to hold said cam plate in said second position; and means for holding said cam plate in said third position when the door is open.

16. An apparatus as recited in claim 15 herein said means for holding said cam plate in said third position when said door is open is said latch, said latch being operatively engageable with said cam plate while being urged into a forward position to hold said cam plate in said third position.

17. An apparatus as recited in claim 16 wherein said cam plate is formed with a groove and said mechanism further comprises a spring loaded keeper pin mounted on said latch to urge against said cam plate and hold said cam plate in said second position when said keeper pin is urged into said groove.

18. An apparatus as recited in claim 17 wherein said means for moving said cam plate comprises:

means connecting said base plate to said cam plate to urge said cam plate toward said first position; and means to counteract said connecting means and selectively pull said cam plate into said second position.

19. An apparatus as recited in claim 18 wherein said means for connecting said base plate to said cam plate is a spring.

20. An apparatus as recited in claim 19 wherein said means to counteract said connecting means is a motor operatively engaged with said cam plate.

* * * * *